United States Patent [19]

McAlister

[11] Patent Number: 4,674,727

[45] Date of Patent: Jun. 23, 1987

[54] STAPLE REMOVER

[76] Inventor: George A. McAlister, 7722 Windmill Hill, San Antonio, Tex. 78229

[21] Appl. No.: 872,029

[22] Filed: Jun. 9, 1986

[51] Int. Cl.[4] ..... B25C 11/02

[52] U.S. Cl. ..... 254/28

[58] Field of Search ..... 254/28, 23, 24

[56] References Cited

U.S. PATENT DOCUMENTS

| | | | |
|---|---|---|---|
| 2,033,050 | 3/1936 | Pankonin | 254/28 |
| 2,553,660 | 5/1951 | Levendusky | 254/28 |
| 2,596,719 | 5/1952 | Pankonin | 254/28 |
| 2,776,109 | 1/1957 | Segal | 254/28 |
| 2,940,727 | 6/1960 | Segal | 254/28 |
| 3,143,800 | 8/1964 | Vizzi | 30/261 |
| 3,311,346 | 3/1967 | Almond, Jr. | 254/28 |
| 3,630,486 | 12/1971 | Foitle | 254/28 |
| 3,764,108 | 10/1973 | Dahlin | 254/28 |
| 3,974,999 | 8/1976 | Bertolet | 254/28 |

FOREIGN PATENT DOCUMENTS

| | | | |
|---|---|---|---|
| 1077634 | 3/1960 | Fed. Rep. of Germany | 254/23 |

*Primary Examiner*—Frederick R. Schmidt
*Assistant Examiner*—Steven P. Schad
*Attorney, Agent, or Firm*—Richards, Harris, Medlock & Andrews

[57] ABSTRACT

A staple remover (10) is provided having first and second arms (12, 14). Each of the arms (12, 14) include parallel sidewalls (16, 18, 22, 24) interconnected by a web (20, 26). Structure (28, 30) is provided for connecting the arms (12, 14) such that the sidewalls (16, 18) are slidable within the sidewalls (22, 24). Structure (50) is disposed between the sidewalls (16, 18) of the first arm (12) for engaging a staple between the engaging structure (50) and the web (26) of the second arm (14).

16 Claims, 9 Drawing Figures

STAPLE REMOVER

TECHNICAL FIELD

This invention relates to a tool for removing wire staples of the type commonly used for securing together sheets of paper or other sheet material inserted by manual or automatic stapling devices, and more particularly to a staple remover for removing broken or partially removed staples.

BACKGROUND ART

Staple removers for removing whole and unbroken staples are widely utilized. Most commonly, such staple removers include a pair of opposed, confronting wedge-shaped cams, which are mounted respectively on a pair of pivotably related arms, adapted to be inserted from opposite sides between the crown of the staple and the top sheet of the stapled material.

In operation of such staple removers, the cams are driven together by relative movement of the arms such that the staple is withdrawn by the wedging action of the cams. This type of staple remover requires, for its efficient operation, that both ends of the staple crown be secured to the paper layers by the crown's associated leg, and that the legs pull free of the layers substantially simultaneously. If the staple wire should break, or be cut between the wedge cams by faulty manipulation of the staple remover, or if one leg of the staple should pull free before the other, the result is that the staple wire is still secured at one end in the paper layers, with a raw end projecting upwardly therefrom. Existing staple removers are ineffective to remove such wire fragments. Manual removal of these wire fragments is difficult, often requiring manipulation by the fingers of a person which may result in finger piercing and broken fingernails caused by the staple wire fragment. It is also extremely difficult to remove partially removed staples which are formed of heavier gauge wire and which are utilized for joining thick layers of material. It is further difficult to remove staples which have been automatically inserted by power driven staplers.

A need has thus arisen for an improved staple remover for the removing of broken or partially removed staples to avoid manual removal of the staple. A need has further arisen for a staple remover that is easy to operate, maintenance free and can be used in combination with presently available staple removers.

DISCLOSURE OF THE INVENTION

In accordance with the present invention, an improved staple remover is provided for removing broken or partially removed staples which substantially eliminates the problems heretofore associated with staple removers.

In accordance with the present invention, a staple remover is provided having first and second arms. Each of the arms includes first and second ends and parallel sidewalls interconnected by a web. Structure is provided for connecting the first ends of the arms so that the second ends of the arms are movable adjacent to one another. Structure is disposed between the sidewalls of the first arm at the second end thereof for engaging a staple between this structure and the web of the second arm at the second end thereof.

In accordance with another aspect of the present invention, a staple remover is provided having first and second arms, each of the arms has first and second ends and each arm further includes parallel sidewalls interconnected by a web. Structure is provided for pivotally connecting the first ends of the arms, such that the sidewalls of the first arm at the second end are slidably engageable with the sidewalls of the second arm at the second end by relative pivotal movement of the arms. An extractor bar having first and second ends is pivotally mounted between the sidewalls of the first arm at the second end thereof for engaging a staple between the second end of the extractor bar and the web of the second arm at the second end thereof. The extractor bar pivots between a first position generally parallel to the web of the first arm and a second position generally perpendicular to the web of the first arm for engaging the staple.

In accordance with another aspect of the present invention, a device for removing staples, broken staples and partially removed staples is provided. The device includes first and second arms. Each of the arms includes first and second ends and each further includes parallel sidewalls interconnected by a web. The web of the first arm has a width less than the web of the web of the second arm. Structure is provided for pivotally connecting the first ends of the arms, such that the sidewalls of the first arm at the second end thereof are slidable between the sidewalls of the second arm at the second end thereof by relative pivotal movement of the arms. The device further includes a bar having first and second ends such that the first end is mounted to the second end of the first arm for contacting the web of the second arm at the second end thereof for engaging a broken or partially removed staple when the first arm slidably engages the second arm. Structure is provided for pivotally mounting the bar between the sidewalls of the first arm, such that the bar rotates between a first position generally parallel to the web of the first arm and a second position generally perpendicular to the web of the first arm for engaging the staple. The arm is configured to prevent it from rotating past the second end of the first arm. The bar further has a width less than the width of the web of the first arm and includes structure extending from the second end thereof and beyond the sidewalls of the first arm. The second ends of the arms include teeth extending from the sidewalls for extracting a staple when the bar is in the first position by relative pivotal movement of the arms, such that the second ends of the arms slidably engage each other.

BRIEF DESCRIPTION OF THE DRAWINGS

For a more complete understanding of the present invention and for further advantages thereof, reference is now made to the following Detailed Description taken in conjunction with the accompanying Drawings in which.

DETAILED DESCRIPTION

Figure 1:
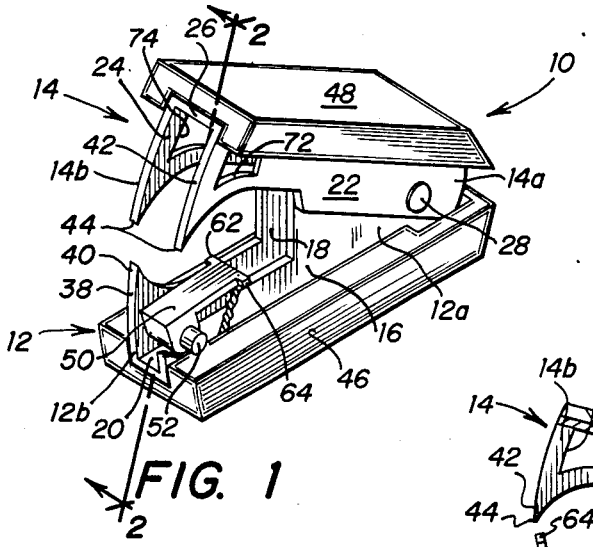
FIG. 1 is a perspective view, partially broken away, of the staple remover of the present invention illustrating the extractor bar in the inoperative position.
Figure 2:
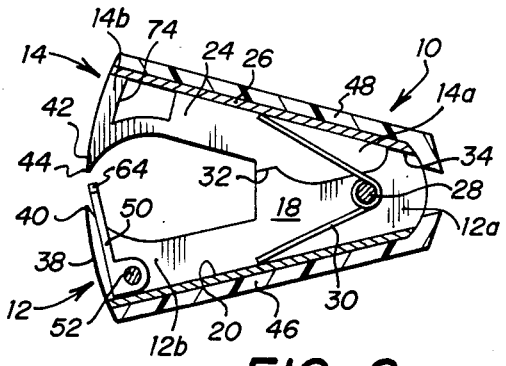
FIG. 2 is a sectional view taken generally along section lines 2—2 of FIG. 1 illustrating the extractor bar in the operative position.

Referring simultaneously to FIGS. 1 and 2, the staple remover of the present invention is illustrated and is generally identified by the numeral 10. Staple remover 10 is utilized for removal of unbroken staples as well as for the removal of broken or partially removed staples utilizing the present invention. Staple remover 10 includes a pair of elongated arms 12 and 14 having ends 12*a*, 12*b*, 14*a* and 14*b*, respectively. Arms 12 and 14 are formed of, for example, sheet material and are of a U-shaped cross-sectional configuration having a web and parallel sidewalls. Arm 12 includes parallel sidewalls 16 and 18 interconnected by a web 20. Similarly, arm 14 includes parallel sidewalls 22 and 24 interconnected by a web 26.

Figure 5:
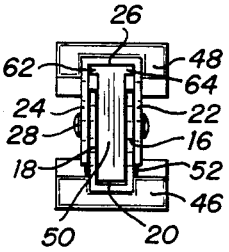
FIG. 5 is a front elevational view of the staple remover shown in FIG. 1 showing the extractor bar positioned to remove a broken or partially removed staple.
Figure 6:
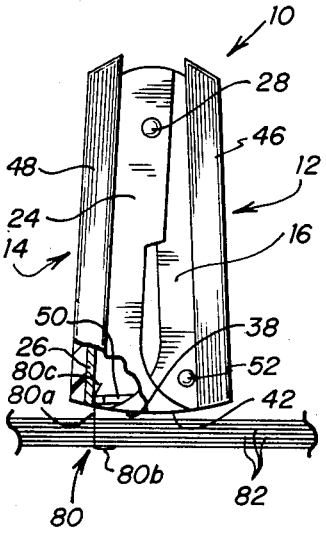
FIG. 6 is a side view of the present staple remover, partially broken away, showing removal of a partially removed staple.

Arms 12 and 14 are configured to slidably engage each other at ends 12*b* and 14*b* such that sidewalls 16 and 18 slide within and between sidewalls 22 and 24. Ends 12*a* and 14*a* of arms 12 and 14 are pivotally engaged by a pivot pin 28 extending through sidewalls 16, 18, 22 and 24. A spring 30 (FIG. 2) biases ends 12*a* and 14*a* of arms 12 and 14, respectively yieldably apart to an open position as shown in FIGS. 1 and 2. Arms 12 and 14 may be manually pushed toward each other against the force of spring 30 to a closed position in which webs 20 and 26 are parallel as shown in FIGS. 5 and 6.

An interior edge 32 of sidewalls 16 and 18 is configured to form a stop which engages the inner surface of web 26 of arm 14 to limit the closing movement of arms 12 and 14. An interior edge 34 of sidewalls 16 and 18 engages web 26 of arm 14 to limit the opening movement of arms 12 and 14.

Sidewalls 16 and 18 include camming surfaces 38 which terminate in teeth 40 at ends 12*b* of arm 12. Similarly, sidewalls 22 and 24 include camming surfaces 42 which terminate in teeth 44 at end 14*b* of arm 14. Teeth 40 project toward arm 14, and teeth 44 project toward arm 12. Teeth 40 and 44 are sharply pointed at their ends for engaging the crown of an unbroken staple. In the open position of arms 12 and 14, teeth 40 and 44 are spaced apart in the plane of pivotal movement of arms 12 and 14, as shown in FIG. 1. In operation of staple remover 10, teeth 40 and 44 are positioned adjacent the staple crown and as arms 12 and 14 are pressed together, teeth 40 and 44 are inserted between the staple crown and top sheet of the material secured by the staple. As arms 12 and 14 are closed, teeth 40 and 44 move into interdigitating relation forcing the staple crown to ride upwardly on camming surfaces 38 and 42 such that the staple is removed by pulling it from the secured material. The operation of staple remover 10 as described is common and well known in the art. A finger plate 46 is secured to web 20 of arm 12 and a finger plate 48 is secured to web 26 of arm 14 to facilitate manipulation of staple remover 10. Finger plates 46 and 48 may be secured by screws, gluing or a rivet (not shown).

Due to faulty manipulation of arms 12 and 14, only one pair of cooperating teeth 40 and 44 may enter between the staple crown and the top sheet of the material secured by the staple. In this configuration one leg of the staple will be removed while the other leg is left tightly engaged in the sheet material when staple remover 10 is pulled. Also, if arms 12 and 14 are improperly placed with respect to the staple, so that a tooth 40 or 44 is placed outwardly from the adjacent staple leg and the cooperating tooth 40 or 44 is disposed inwardly of the staple leg, the staple wire may be cut and severed completely between the edges of the cooperating teeth 40 and 44. Additionally, due to faults or metal fatigue in the staple wires themselves, the staple crown may break before the legs thereof are fully freed from the sheet material. In any of these instances, the result is that one or two wire fragments are still secured at one end in the sheet material with the opposite end extending outwardly from the sheet. The standard staple remover thus described is inoperable nor adapted to grip or remove these fragments, and their manual removal is a tedious and annoying task, often resulting in pierced fingers and broken fingernails as previously mentioned. The present invention utilizes an extractor bar 50 rotatable between the nonoperating position shown in FIG. 1 and an operating position shown in FIG. 2. The use of staple remover 10 in combination with extractor bar 50 provides for a staple remover for removing wire fragments of a staple which is broken or partially removed.

Figure 3:
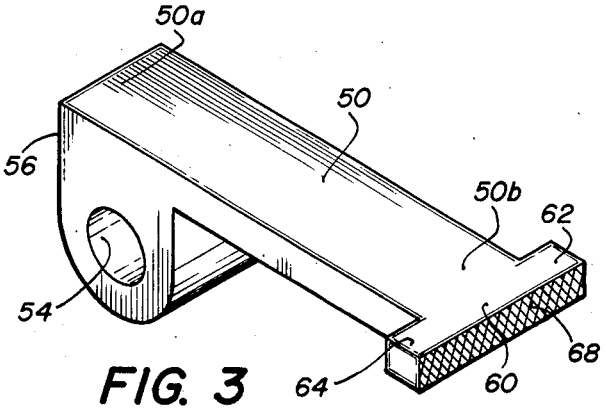
FIG. 3 is an enlarged perspective view of the extractor bar of the present invention.

Referring simultaneously to FIGS. 1, 2 and 3, extractor bar 50 includes an elongated bar having ends 50*a* and 50*b*. Extractor bar 50 is pivotally mounted to end 12*b* of arm 12 between sidewalls 16 and 18 utilizing a pivot pin 52. Pivot pin 52 is inserted within an aperture 54 within end 50*a* of an extractor bar 50. As shown in FIG. 1, extractor bar 50 in the nonoperating position lies substantially parallel to web 20 of arm 12. As shown in FIG. 2, extractor bar 50 in the operating position is disposed substantially perpendicular to web 20 of arm 12. In order to maintain the perpendicular relationship between extractor bar 50 and arm 12, end 50*a* of extractor bar 50 includes a flat surface 56 for mating with web 20 of arm 12 in the operative position of extractor bar 50.

End 50*b* of extractor bar 50 includes a T-shaped extension 60 having lugs 62 and 64. Lugs 62 and 64 maintain extractor bar 50 on the surface of sidewalls 16 and 18 of arm 12 in the nonoperating position. Lugs 62 and 64 further provide the user of staple remover 10 with structure to easily lift extractor bar 50 to the operating position shown in FIG. 2. Extension 60 further includes a knurled surface 68 for assisting grasping a staple wire.

Referring again to FIGS. 1 and 2, disposed within sidewalls 22 and 24 of arm 14 are windows 72 and 74, respectively. Windows 72 and 74 provide the user of staple remover 10 with a better view of extractor bar 50 engaging a staple during removal.

Figure 4:
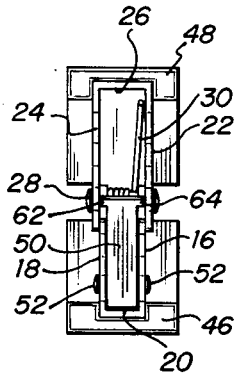
FIG. 4 is a front elevational view of the staple remover shown in FIG. 1 with the extractor bar initially positioned to remove a broken or partially removed staple.

Referring now to FIGS. 4, 5 and 6, the use of extractor bar 50 in combination with staple remover 10 for extracting a broken or partially removed staple will now be described. Extractor bar 50 is positioned such that it is generally perpendicular to web 20 of arm 12. Arms 12 and 14 are pressed toward one another such that sidewalls 16 and 18 of arm 12 begin to engage sidewalls 22 and 24 of arm 14 as shown in FIG. 4. The extension 60 of extractor bar 50 lies between sidewalls 22 and 24 of arm 14. As shown in FIG. 5, when arms 12 and 14 are in the fully closed position, the extension 60 of extractor bar 50 is positioned to contact web 26 of arm 14. Extension 60 lies parallel to web 60 such that knurled surface 68 contacts web 26.

FIG. 6 illustrates the use of the present staple remover 10 to remove a partially removed staple generally identified by the numeral 80 used to secure sheets 82. Staple 80 includes a crown portion 80*a* and legs 80*b* and 80*c*. Staple remover 10 is positioned adjacent leg 80*c* of staple 80 such that leg 80*c* is positioned between teeth 40 and 44 of arms 12 and 14, respectively. With extractor bar 50 positioned as shown in FIGS. 4 and 5, leg 80*c* of staple 80 is grasped between knurled surface 68 and web 26 of arm 14. Once grasped, staple remover 10 is pulled upwardly to thereby disengage leg 80*b* of staple 80 from sheets 82. Extractor bar 50 in combination with arm 14 therefore functions to grip the staple 80 whereupon the entire staple remover 10 may be used as a pliers for forcibly pulling staple 80 from sheets 82.

Referring again to FIGS. 4 and 5, the width of extractor bar 50 is substantially equal to the width of web 20 of arm 12. The extension 60 of extractor bar 50 has a width substantially equal to the width of web 26 of arm 14. It therefore can be seen that extractor bar 50 is slidable between sidewalls 22 and 24 of arm 14. The extension 60 has a width substantially equal to the width of web 26 such that the full width of web 26 can be utilized for grasping the broken or partially removed staple between sidewalls 22 and 24 of arm 14. The length of extractor bar 50 is such that extractor bar 50 extends beyond tooth 40 of arm 16, but not as far as tooth 44 when arms 12 and 14 are in the open position so that a gap is formed between tooth 44 and extractor bar 50 in the open position. The length of extractor bar 50 ensures that extension 60 will contact web 26 of arm 14 before arms 12 and 14 fully close.

Alternatively, extractor bar 50 can be pivotally mounted between sidewalls 22 and 24 of arm 14. In such an embodiment, end 50*a* of extractor bar 50 would be mounted between sidewalls 22 and 24 of arm 14 adjacent web 26. Lugs 62 and 64 would not be utilized as this structure extends beyond the width of sidewalls 16 and 18 of arm 12. The operation of staple remover 10 having extractor bar 50 mounted to arm 14 would be similar to that described with respect to FIGS. 4, 5 and 6.

Figure 7:
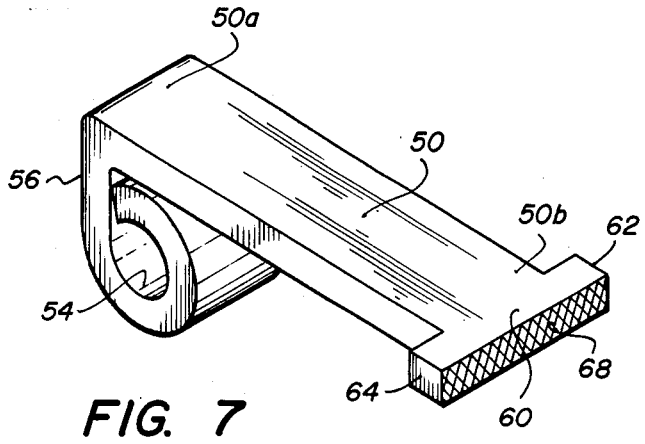
FIG. 7 is a perspective view of an additional embodiment of the extractor bar of the present invention.

Although extractor bar 50 has been illustrated in FIG. 3 as being a solid bar having an aperture 54, extractor bar 50 can be fabricated from a rectangular ribbon-like material in which end 50*a* is rolled to form aperture 54 as shown in FIG. 7. In either configuration, aperture 54 and pivot pin 52 are frictionally engaged, such as by using a friction washer between pivot pin 52 and aperture 54, to maintain extractor bar 50 in the operable position as illustrated in FIG. 2.

Figure 8:
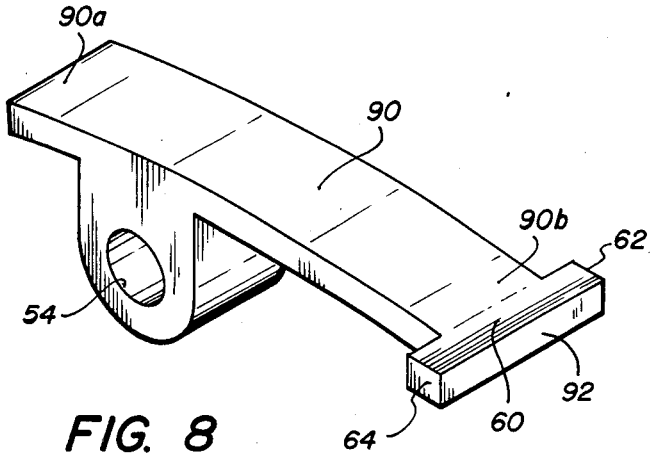
FIG. 8 is a perspective view of an additional embodiment of the extractor bar of the present invention.
Figure 9:
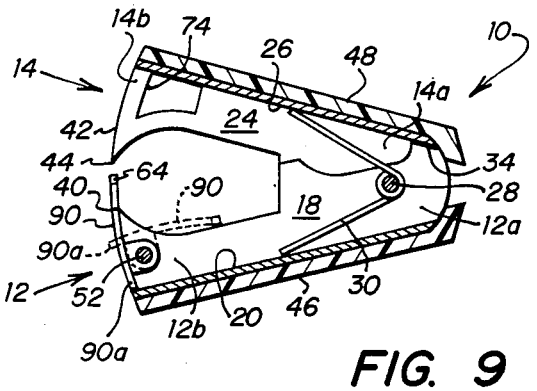
FIG. 9 is a sectional view similar to FIG. 2 illustrating the operation of the extractor bar shown in FIG. 8.

Referring now to FIGS. 8 and 9, wherein like numerals are utilized for like and corresponding components previously identified, an additional embodiment of the present extractor bar is illustrated. Extractor bar 90 includes an arcuate configuration between ends 90*a* and 90*b* similar to the curvature of camming surfaces 38 and 42. This configuration assists the user in moving extractor bar 90 between its two positions shown in FIG. 9. End 90*a* engages web 20 generally perpendicularly in the operative position. End 90*b* and particularly, surface 92, engages web 26 generally perpendicular to engage a staple wire. Although surface 68 of extractor bar 50 (FIG. 3) has been illustrated as having a knurled surface, surface 92 of extractor bar 90 may be smooth.

It therefore can be seen that the present staple remover provides for a staple remover having numerous advantages including convenience, ease of operation and construction for the removal of broken and partially removed staples. The present staple remover combines the ordinary function of removing staples with the additional function of removing broken or partially removed staples in a single tool. Both functions are capable of being utilized independently and do not interfere with the operation of the staple remover.

Whereas the present invention has been described with respect to specific embodiments thereof, it will be understood that various changes and modifications will be suggested to one skilled in the art and it is intended to encompass such changes and modifications as fall within the scope of the appended claims.

I claim:

1. A staple remover comprising:

first and second arms, each of said arms having first and second ends and further including parallel sidewalls interconnected by a web;

said second ends of said first and second arms including teeth means extending from said sidewalls for engaging and extracting a staple;

means for pivotally connecting said first ends of said first and second arms, such that said sidewalls of said first arm at said second end thereof slidably engage said sidewalls of said second arm at said second end thereof by relative pivotal movement of said first and second arms;

engaging means having first and second ends, said first end thereof being pivotally mounted between said sidewalls of said first arm at said second end thereof for engaging a staple between said second end of said engaging means and said web of said second arm at said second end thereof;

said engaging means being pivotally mounted for rotation between a first position generally parallel to said web of said first arm and a second position generally perpendicular to said web of said first arm for engaging the staple; and said engaging means further having a width less than the width of said web of said first arm.

2. The staple remover of claim 1 wherein said engaging means includes a bar having a length greater than the length of said sidewalls of said first arm.

3. The staple remover of claim 1 wherein said engaging means includes a bar having a length greater than the length of said sidewalls of said first arm and extending beyond said sidewalls of said first arm for engaging said web of said second arm.

4. The staple remover of claim 3 and further including:

means extending from said second end of said bar for increasing the width of said second end thereof to be substantially equal the distance between said sidewalls of said second arm.

5. The staple remover of claim 4 wherein said means extending from said second end of said bar includes a knurled surface engaging the staple.

6. The staple remover of claim 1 wherein said second end of said engaging means includes means extending from said second end thereof for preventing said second end of said engaging means from contacting said web of said first arm.

7. The staple remover of claim 1 wherein the width of said web of said first arm is less than the width of said web of said second arm, such that said sidewalls of said first arm are slidable between said sidewalls of said second arm.

8. The staple remover of claim 1 wherein said second end of said engaging means includes:

means extending from said second end and beyond said sidewalls of said first arm for increasing the width of said engaging means to substantially equal the width of said web of said second arm.

9. A device for removing staples, broken staples and partially removed staples comprising:

first and second arms, each of said arms having first and second ends and each further including parallel sidewalls interconnected by a web, said web of said first arm having a width less than the width of said web of said second arm;

means for pivotally connecting said first ends of said first and second arms, such that said sidewalls of said first arm at said second end thereof are slideable between said sidewalls of said second arm at said second end thereof, by relative pivotal movement of said first and second arms;

engaging means having first and second ends, said first end thereof being pivotally mounted to said second end of said first arm for contacting said web of said second arm at said second end thereof for engaging a broken or partially removed staple when said first arm slidably engages said second arm;

means for pivotally mounting said engaging means between said sidewalls of said first arm, such that said engaging means rotates between a first position generally parallel to said web of said first arm and a second position generally perpendicular to said web of said first arm for engaging the staple and such that said engaging means is prevented from rotating past said second end of said first arm;

said engaging means having a width less than the width of said web of said first arm and further including means extending from said second end thereof and beyond said sidewalls of said first arm, said extending means having a width substantially equal to the width of said web of said second arm; and said second ends of said first and second arms including teeth means extending from said sidewalls for extracting a staple when said engaging means is in said first position by relative pivotal movement of said first and second arms, such that said second ends of said arms slidably engage each other and the staple for removal.

10. The device of claim 9 and further including:

means disposed within said second arm for viewing said second end of said engaging means.

11. The device of claim 9 wherein said extending means includes a knurled surface for gripping the staple.

12. The device of claim 9 wherein said means for pivotally mounting said engaging means includes pivot means extending through said engaging means and said sidewalls of said first arm adjacent said second end of said first arm.

13. The device of claim 9 wherein said means for pivotally connecting said first and second arms at said first ends thereof includes spring means for biasing said arms, such that said second ends of said arms are maintained spaced apart.

14. The device of claim 9 and further including:

means mounted to said webs of said first and second arms for gripping the device.

15. The device of claim 9 wherein said second ends of said first and second arms include an arcuate surface to facilitate a camming action thereof in removing a staple.

16. The device of claim 9 wherein said engaging means is arcuately curved between said first and second ends thereof.

* * * * *